United States Patent [19]

Vetter et al.

[11] 4,229,064

[45] Oct. 21, 1980

[54] POLARIZING ADAPTER SLEEVES FOR ELECTRICAL CONNECTORS

[75] Inventors: Ottomar H. Vetter, Golden Valley; Terrance W. Hanlon, Blaine, both of Minn.

[73] Assignee: TRW Inc., Minneapolis, Minn.

[21] Appl. No.: 954,615

[22] Filed: Oct. 25, 1978

[51] Int. Cl.[2] ..... H01R 13/64

[52] U.S. Cl. ..... 339/186 M

[58] Field of Search ..... 339/90 R, 186 R, 89, 339/90, 186, 186 M, 89 M, 113 R

[56] References Cited

U.S. PATENT DOCUMENTS

| | | | |
|---|---|---|---|
| 2,933,711 | 4/1960 | Eaton | 339/90 R |
| 3,116,942 | 1/1964 | Morello | 339/90 R X |
| 3,252,124 | 5/1966 | Hansen | 339/90 R X |
| 3,892,458 | 7/1975 | Clark | 339/90 R |
| 3,901,574 | 8/1975 | Paullus | 339/90 R |
| 4,111,514 | 9/1978 | Brishka | 339/186 R |
| 4,146,288 | 3/1979 | Ramsay | 339/90 R |

*Primary Examiner*—Neil Abrams
*Assistant Examiner*—John S. Brown
*Attorney, Agent, or Firm*—Peterson, Palmatier, Sturm & Sjoquist, Ltd.

[57] ABSTRACT

A first adapter sleeve snaps onto an outside portion of the plug component of an electrical connector and a second adapter sleeve snaps over an outside portion of the coupling ring which is part of the receptacle component of the connector. The first adapter sleeve has formed therein a number of keyways having a particular angular spacing. In order for the components to be mated or coupled together, the second sleeve must have formed thereon a number of keys corresponding to the number of keyways formed in the first sleeve and also have the same angular spacing. In this way, a plurality of first and second adapter sleeves having different key and keyway patterns can be provided so as to prevent the mismating of otherwise identical connector components.

16 Claims, 7 Drawing Figures

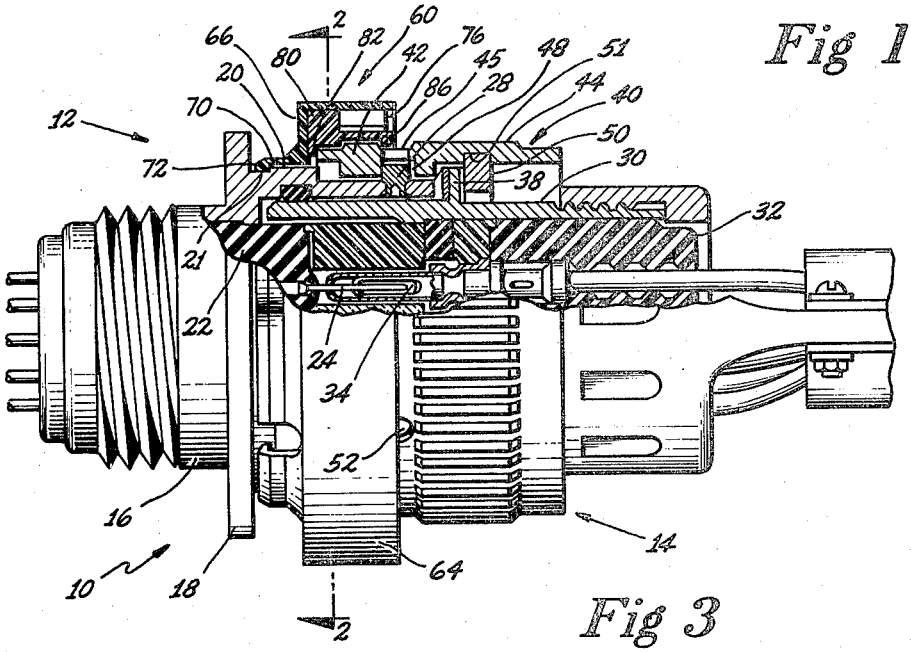
Fig 1
Fig 3
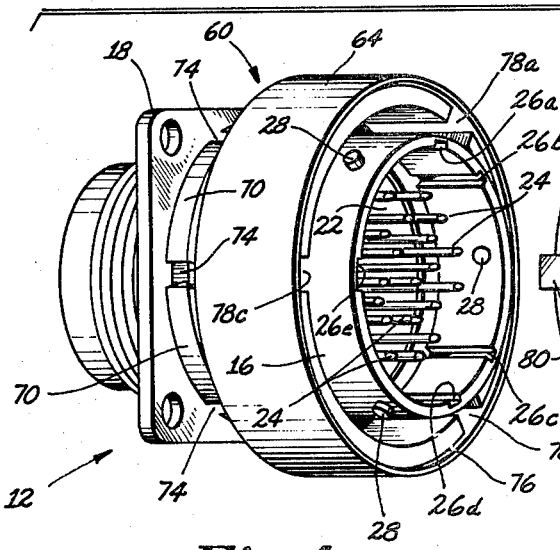
Fig 4
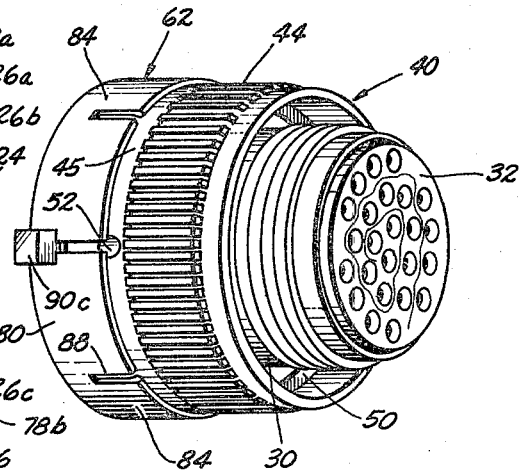
Fig 5
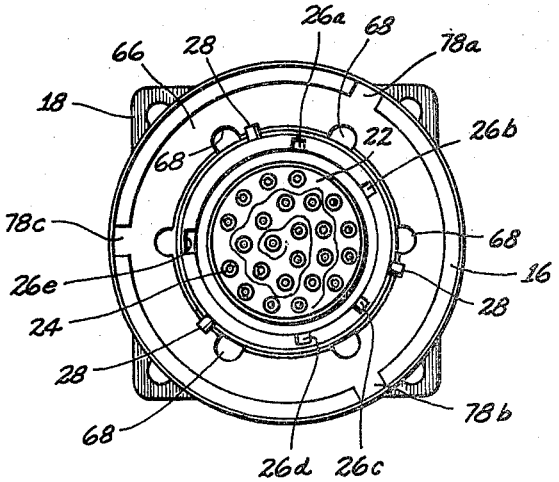
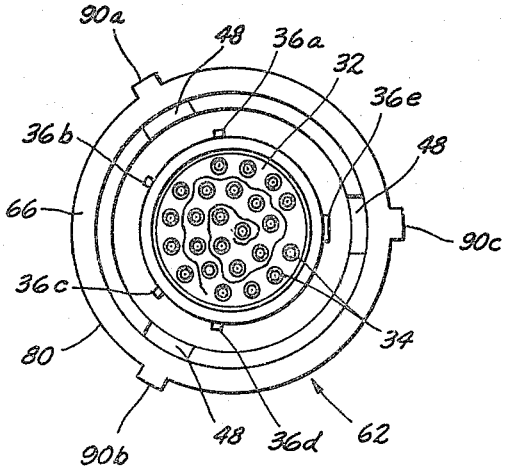

POLARIZING ADAPTER SLEEVES FOR ELECTRICAL CONNECTORS

BACKGROUND OF THE INVENTION

1. Field of the Invention

This invention relates generally to electrical connectors, and pertains more particularly to adapters for determining the polarization of connectors.

2. Description of the Prior Art

The need for indexing or polarizing electrical connectors has been recognized for some time. Obviously, the mismating of a plug component with the wrong receptacle component can in a number of situations prove disastrous. The problem is particularly acute in aeronautical and aerospace installations where electrical connectors must frequently be coupled together in confined spaces where the operator must reach through small access openings and cannot see what he is doing.

In the type of installation alluded to above, it becomes readily apparent that a color coding system is completely ineffectual because the operator is unable to see the connector components. One solution to the problem is for the manufacturer to provide various plug and receptacle components that have a sufficient number of different key and keyway configurations permanently embodied therein so that only those components with the same key and keyway patterns can be coupled together. However, this necessitates the stocking of relatively large numbers of male and female components that are physically identical other than for their key and keyway patterns.

Furthermore, the reliance on built-in different key and keyway patterns increases the cost of manufacturing such electrical connectors because different tooling is required for each different pattern. Also, the cataloging and inventorying of a large number of connectors proves troublesome and expensive.

Still further, the installer or connector user must have the proper number of differently indexed connectors at the job site and must plan ahead so that he is certain that he is wiring the correct male component for use with the proper female component. In other words, if the installer inadvertently wired one plug component into a first circuit and then by mistake selected the wrong receptacle component and wired it into a second circuit to be connected to the first circuit, he would have to rewire one or the other just to obtain a compatible keying pattern, for he would not be able to change either built-in pattern.

Because of the stockpiling and concomitant difficulties experienced with predesigned keying patterns which cannot be modified, efforts have been made in the past to provide connectors possessing keying patterns that could be altered. For instance, U.S. Pat. No. 3,287,031 granted to Simmons et al for an "Indexed Key Connection" makes use of removable plugs. This requires a number of slots in both the male and female components, plugs being inserted into selected slots so that only the components with the same plug insertions can be mated together. In a somewhat similar vein, U.S. Pat. No. 3,614,711 issued to Henderson et al for "Electrical Connector Having Adjustable Keying" employs grooves in which plugs can be removed to provide a keyway and metal prongs that can be bent to provide keys receivable in those keyways from which the plugs have been removed. Not only is the cost of manufacturing connectors of the foregoing categories more expensive, but it is a bother to add and remove plugs. Furthermore, especially since not too many keying arrangements are possible, one could inadvertently adopt the same pattern for two connectors without recognizing it, thereby permitting mismating of components.

U.S. Pat. No. 3,097,905 granted to Shearer et al for "Indexable Key Connector" teaches the use of an adapter but such an arrangement permits only one component to be modified for use with a component having a fixed keyway pattern. Furthermore, the connector must be specially designed so as to accommodate the adapter, the connector shell belonging to one of the components requiring notches which must correspond in number and spacing to inwardly directed lugs on the adapter. Still further, a locking nut is required.

Consequently, the patented construction just referred to is unduly complex and costly. Still further, it does not have the degree of versatility as far as rendering various male and female components mateable. In other words, the arrangement described in the patent does not allow standard components to be indexed or polarized.

SUMMARY OF THE INVENTION

One important object of our invention is to provide a means for indexing or determining the polarity of electrical connectors without having to physically modify them either at the factory or at the time of installation. A more specific aim is to allow the indexing of connectors already in existence.

Another object is to provide an adapter arrangement that will permit a large number of polarity combinations to be readily achieved. For example, the customer need only purchase standard electrical connectors of the various sizes that are required and he can add to the connectors the appropriate adapters to give a particular keying configuration that will permit only the appropriate components to be coupled together. This can be done on the job.

Still another object is to provide adapter sleeves that can be quickly added or later removed just as readily.

Another object is to provide a means for determining the polarization of an electrical connector which means will be very inexpensive to manufacture.

Another object of the invention is to avoid the need for establishing any special angular orientation of the adapters, the invention permitting the sleeves to be snapped on the respective components of a connector, the adapters being free to rotate automatically into registry as the components are coupled in the usual manner.

Although it is not the intention of the invention to eliminate the permanent keying of male and female electrical components, an object of the invention is to utilize only a bare minimum of permanent keying which can be costly to build into a connector, relying instead upon the pattern provided by our adapter sleeves. An aim of the invention is to provide an adapter arrangement that is compatible with whatever permanent indexing already exists.

Also, an object of the invention is to reduce the inventory of electrical connectors that must be kept in stock by the manufacturer and the customer.

Still further, an object is to facilitate the continued color coding of electrical components, doing so via the adapter sleeves themselves. Thus, the user is always apprised of connector components that can be mated together when his visibility is not obscured.

Also, the invention enables the continued use of peepholes and registry lines to indicate when electrical connector components have been fully coupled together. As already pointed out, it is not always possible for the worker to see what he is doing but where visibility is possible he can continue to use the peepholes and registry lines as a check against a faulty or incomplete coupling of the components.

Another object is to provide adapter sleeves that will not take up any significant amount of space, thereby preserving the compactness of the connector which can be quite important.

A further object of the invention is to provide adapter sleeves that at most require only a fraction of a turn or portion of a coupling movement greater than that required to connect conventional connector components.

Yet another object is to provide adapter sleeves that can be fabricated from plastic, thereby providing additional insulation between connectors and with respect to ground.

Briefly, our invention contemplates the employment of a plurality of adapter sleeves having various keys and keyway patterns. By varying the number of keys and keyways, only those components can be mated or coupled together that have the same keying configurations. The adapter sleeves can be snapped on any standard connector of a given size. A kit containing any preferred number of paired adapter sleeves can be supplied so that electrical connectors can literally be customized as far as their indexing or polarization patterns are concerned.

BRIEF DESCRIPTION OF THE DRAWINGS

FIG. 1 is a side elevational view of a coupled electrical connector utilizing one pair of adapter sleeves fabricated in accordance with the invention, the upper portion of the connector and the adapter sleeves being shown in section;

FIG. 3 is an exploded perspective view of the connector components of FIG. 1 when uncoupled;

FIG. 4 is an end view looking toward the pin contacts of the receptacle component;

FIG. 5 is an end view looking toward the socket contacts of the plug component;

DESCRIPTION OF THE PREFERRED EMBODIMENTS

Figure 6:
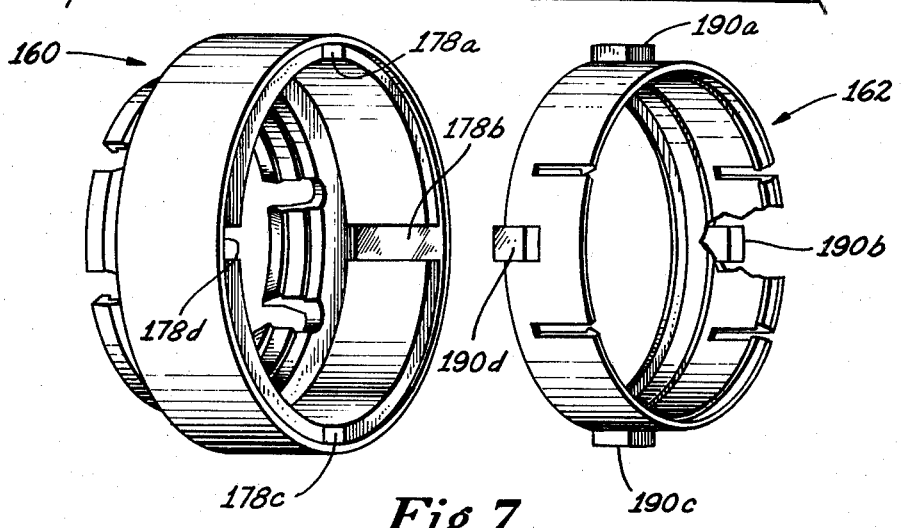
FIG. 6 is a perspective view of a second pair of adapter sleeves having a different key and keyway pattern from that used with the adapter sleeves appearing in FIGS. 1–4.

Inasmuch as our invention can be utilized in conjunction with virtually any standardized electrical connector, the connector will not be described with any great particularity. Actually, the connector appearing in the drawings can be the same as that disclosed in U.S. Pat. No. 3,750,087 granted to Ottomar H. Vetter for "Preloaded Electrical Connector" and assigned to TRW, Inc., the present assignee. However, even though the connector is susceptible to modification and will still permit our invention to be utilized, it will be helpful, it is believed, to refer to some of the salient or main parts constituting the connector. Accordingly, the electrical connector has been denoted generally by the reference numeral 10 and comprises a receptacle or female component 12 and a plug or male component 14.

Describing the receptacle component 12 in somewhat greater detail, it is to be observed that it includes a cylindrical shell 16 having a mounting flange 18 integral therewith. Spaced longitudinally from the mounting flange 18 a slight distance is an annular flange or rib 20 forming a groove 21 between it and the flange 18, the groove 21 extending circumferentially around the shell 16.

Disposed within the shell 16 is a rubber insert 22 containing any preferred number of pin contacts 24. The interior of the shell 16, it will be observed, is conventionally provided with a plurality of longitudinally directed keyways 26*a*, 26*b*, 26*c*, 26*d* and 26*e* (see FIG. 4), these keyways providing a fixed or permanent polarity arrangement. As the description progresses, it will be appreciated that at least one keyway, such as the keyway 26*a* should be provided. Cooperating in the coupling or mating of the plug component 14 with the receptacle component 12 are three bayonnets 28 that project radially outward from the shell 16.

As far as the plug component 14 is concerned, it comprises a cylindrical shell 30 having a rubber insert 32 contained therein which houses a number of socket contacts 34, the number of contacts 34 being in accordance with the number of pin contacts 24. Coacting with the previously mentioned keyways 26*a*, 26*b*, 26*c*, 26*d* and 26*e* are keys 36*a*, 36*b*, 36*c*, 36*d* and 36*e*. Whereas the keyway 26*a* and the key 36*a* are essential for guiding the pin contacts 24 into the socket contacts 34, the additional keyways 26*b*, 26*c*, 26*d* and 26*e* and the additional keys 36*b*, 36*c*, 36*d* and 36*e* are conventionally used in order to provide the fixed polarization herein mentioned and which has heretofore been employed in many electrical connectors currently being marketed. As the description progresses, it should become apparent that our invention permits all but one keyway and key to be eliminated as far as any permanent or built-in keying is concerned.

Figure 2:
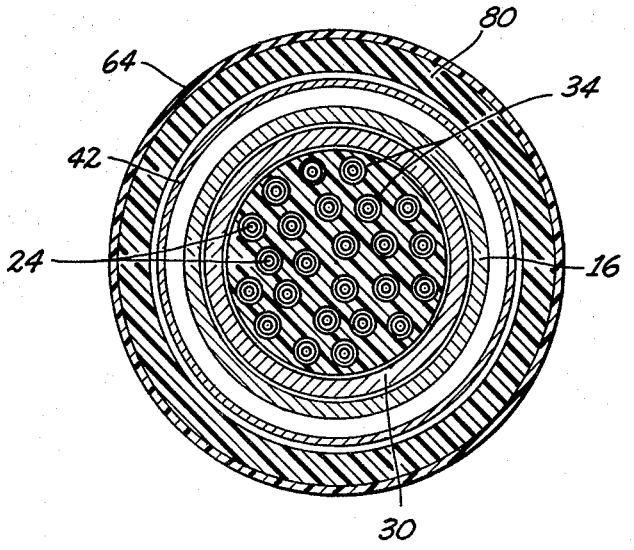
FIG. 2 is a transverse sectional view taken in the direction of line 2—2 of FIG. 1.

From FIG. 2, it will be discerned that the shell 30 has an outwardly directed annular flange 38 thereon. This flange is more fully described in aforesaid U.S. Pat. No. 3,750,087. All that need be understood at the present ime is that it coacts with other parts in effecting the coupling of the plug component 14 with the receptacle component 12.

Included with the receptacle component 12 is a conventional coupling ring 40 having a pair of annular flange or ribs 42, 44 forming a circumferential groove 45 therebetween. Although only the entrances thereto are visible in FIG. 5, it will be appreciated that the usual helical ramp grooves (one appears in FIG. 1), which are labeled 48, are provided within the coupling ring 40. In this way, the relative rotation of the coupling ring 40 with respect to the shell 30 will be instrumental in pulling the shell 30 in the direction of the shell 16 so as to couple or mate together the plug and receptacle components 14 and 12, respectively. Stated somewhat differently, the rotation of the coupling ring 40 causes the socket contacts 34 which are contained within the shell 30 to be advanced into electrical engagement with the pin contacts 24. In this regard, attention is called to a retainer 50 which is received in a groove 51 formed within the coupling ring 40. Inasmuch as U.S. Pat. No. 3,750,087 adequately portrays the coupling action, although the retainer is threadedly received in the coupling ring of said patent, it need only be stated at this point that the retainer 50 bears against certain parts sandwiched in between the retainer 50 and the flange 38 to effect the coupling action.

When fully coupled, peepholes 52 are brought into registry with the bayonnets 28. In other words, there being three bayonnets 28 in the illustrated situation, the three peepholes 52 (although only one is visible in FIG. 1) enable the user to visually ascertain that the components 12 and 14 have been fully coupled together. Also, lines (not visible) on the flange 20, there being three sets of such lines, are moved into juxtaposition or alignment with three lines (also not visible) on the coupling ring 40 when the components 12 and 14 have been fully mated. Thus, there is a dual method of ascertaining when the plug component 14 is completely engaged with the receptacle component 12.

The foregoing description has, as believed evident, dealt with an exemplary electrical connector construction 10. Nonetheless, such a background description should provide a better appreciation of our invention which will now be described.

In this regard, two adapter sleeves 60 and 62 are depicted in FIGS. 1–5 providing one specific polarity. Preferably, these sleeves 60 and 62 are fabricated from plastic, such as nylon or Teflon. It is preferable to utilize a dielectric material in order to insulate better the connector 10 from adjacent connectors and from ground. Of course, the rubber inserts 22 and 32 provide adequate insulation; the sleeves 60, 62 provide additional assurance. The nylon or Teflon are excellent materials for this reason and also isolate the connector against mechanical shock and impact.

Referring in detail now to the adapter sleeve 60, it will be discerned that it includes a cylindrical body 64 having an inwardly directed flange 66. From FIG. 4, it can be perceived that the flange 66 at its inner edge has formed therein a plurality of angularly spaced notches 68. Projecting from the inner edge of the flange 66 are resilient fingers 70, the fingers 70 having an arcuate cross section residing in a cylindrical plane corresponding to that of the shell 16. The free end of each resilient finger 70 has a rib 72 formed thereon which is received in the groove 21 to prevent inadvertent detachment of the sleeve from the component 12, yet permitting facile intentional detachment. Between the resilient fingers 70 are slots 74 (FIG. 3) which actually form longitudinal continuations of the radially oriented notches 68. As can be understood from FIGS. 2 and 3, the vertical or radial notches 68 and the longitudinal or horizontal slots 74 form an L-shaped configuration. The point to be stressed is that the fingers 70 are resilient or flexible so as to flex sufficiently when the sleeve 60 is manually forced onto the shell 16 and yet retain the sleeve in place until deliberately removed. Stated somewhat differently, the notches 68 contribute to the overall flexing action, a portion of the inwardly directed flange 66 deflecting along with the fingers 70 to permit the sleeve 60 to be literally snapped onto the shell 16.

The cylindrical body 64 of the adapter sleeve 60 is formed with a slight counterbore at 76. More importantly, though, is the fact that the cylindrical body 64 has a radial thickness sufficient to permit the forming of keyways **78*a*, 78*b* and 78*c* therein. These keyways 78*a*, 78*b* and 78*c* in the present instance are spaced at equal angles from each other, more specifically 120°. However, as the description progresses, it will be appreciated that other keyway patterns or configurations can be utilized to provide other polarity combinations. See FIGS. 6 and 7**.

Describing at this time the construction of the second adapter sleeve 62, it will be seen that it has a cylindrical body 80 which is telescopically receivable within the cylindrical body 64 of the sleeve 60. The cylindrical body 80 has substantially the same internal diameter as the external diameter of the coupling ring 40. There is an inwardly directed flange 82 on the body 80 which serves as a stop when the sleeve 62 is snapped onto the coupling ring 40, the flange 82 then bearing against the left edge of the coupling ring.

The adapter sleeve 62 further includes a plurality of resilient fingers 84 which are integrally connected to the cylindrical body 80, these fingers having an arcuate cross section residing in a cylindrical plane corresponding to that of the coupling ring 40. As with the fingers 70 the free ends of the fingers 84 each have an inwardly projecting rib thereon, the ribs in this instance being identified by the reference numeral 86. There are slots 88 between the resilient fingers 84. Thus, the ribs 86 when the sleeve 62 is placed on the coupling ring 40 fit into the previously mentioned circumferential groove 45.

Inasmuch as the adapter sleeve 60 has three angularly spaced keyways **78*a*, 78*b*, 78*c* therein, the adapter sleeve 62 has three angularly spaced keys 90*a*, 90*b* and 90*c* thereon which project radially from the body 80. The number of keys 90 is equal to the number of keyways 78**, and the angular spacing, more specifically 120°, is the same also.

It should be understood from the foregoing description that the presence of the adapter sleeves 60, 62 determines the polarization of the electrical connector 10. All that the user need do is to snap the sleeve 60 in place on the shell 16, three of the six notches 68 permitting the flange 66 to pass by the three bayonnets 28. Continued advancement of the sleeve 60 will cause the ribs 72 to engage the circumferential groove 21, the outwardly deflected resilient fingers 70 flexing inwardly when the ribs 72 reach the groove 21.

By the same token, the sleeve 62 can be advanced onto the coupling ring 40 until the inwardly directed flange 82 abuts the left edge of the coupling ring 40, the ribs 86 on the resilient or spring fingers 84 entering the circumferential groove 45 by reason of the fingers 84 flexing inwardly from their outwardly deflected condition.

In both instances, the adapter sleeves 60 and 62 once installed are free to rotate on their respective components 12 and 14. All that the user need do is to couple the connector 10 in the usual manner, bringing the two components 12 and 14 together and then twisting the coupling ring 40 relative to the sleeve 16 which rotation causes the keys **90*a*, 90*b* and 90*c* to revolve into registry with the keyways 78*a*, 78*b* and 78*c*. After the keys 90*a*, 90*b*, 90*c* have entered the keyways 78*a*, 78*b*, 78*c*, then the continued coupling action will cause the bayonnets 28 to move into the helical ramp grooves 48 formed within the coupling ring 40, which they cannot do unless the keys 90*a*, 90*b* and 90*c* enter the keyways 78*a*, 78*b* and 78*c*, and which can only happen if there is a correspondence as to the number of keys and keyways, an identity as to angular spacing between the keys and keyways (which is 120° in this illustrative instance), and additionally a correspondence in width of the keys and keyways. It should be recognized, though, that unless the keys 90*a*, 90*b* and 90*c* can enter the keyways 78*a***, 78*b* and 78*c*, there can be no coupling or mating of the components 12 and 14, for if the keys are not in the keyways, the bayonnets 28 cannot enter the helical ramp grooves 48 to initiate the coupling action. Once the keys 90*a*, 90*b* and 90*c* have entered the keyways 78*a*, 78*b* and 78*c*, the coupling or mating, when fully consummated, results in the cylindrical body 80 being telescopically received within the cylindrical body 64, as can be understood from FIG. 1.

In the past, it has been customary to provide any number of keyways 26*a*, 26*b*, 26*c*, 26*d* and 26*e* and a corresponding number of keys 36*a*, 36*b*, 36*c*, 36*d* and 36*e* on the electrical components constituting an electrical connector. It should be appreciated, however, that these keyways 26 and the keys 36 in the past have been permanently incorporated into the plug and receptacle components 14 and 12. While they provide insurance, as intended, against mismating of the components 12 and 14, it must be recognized that the pattern selected is a permanent one and is not susceptible to alteration.

Consequently, other electrical connectors, the components of which must not be mismated should contain other keyway and key patterns that are dissimilar from the one just mentioned. Permanent and unchangeable patterns require the stocking of numerous electrical connectors of the same size just to make certain that a sufficient number of polarity combinations are provided so that only the male and female components that are intended to be mated can be mated. As already pointed out, this is a decided drawback.

For example in actual practice, it is customary to provide electrical connectors having nine or so shell sizes. To provide even eleven polarity combinations for each shell size necessitates the carrying in inventory ten times as many connectors as is necessary when practicing our invention.

While there would still be one keyway, such as the keyway 26*a*, and one key, such as the key 36*a*, employed so as to assure that the pin contacts 24 will enter the socket contacts 34, four of the keyways (those labeled 26*b*, 26*c*, 26*d* and 26*e*) and four keys (those labeled 36*b*, 36*c*, 36*d* and 36*e*) can be eliminated when following the teachings of our invention. It is within the purview of the instant invention to shift the indexing function performed by the shells 16 and 30 to the adapter rings 60 and 62. Consequently, while there can be nine or so shell sizes, there is no need when utilizing the hereindescribed invention to have more then one key pattern for the same shell size, and even this pattern can be extremely simple, such as a single key and keyway.

As indicated above, polarity distinctions are taken care of by varying the key and keyway configurations of the adapter sleeves 60 and 62. It is important to understand, however, that whatever permanent key and keyway pattern already exists as far as a given size electrical connector is concerned, such a pattern in no way interferes with the use of the adapter sleeves 60 and 62. The sleeves 60 and 62 are free to rotate relative to the plug and receptacle components 14 and 12, thereby permitting whatever permanent indexing there is to take place once the keys 90*a*, 90*b* and 90*c* have entered the keyways 78*a*, 78*b* and 78*c*.

At this time, attention is directed to FIG. 6 in which two different adapter sleeves 160 and 162 are pictured. In this instance, the adapter sleeve 160 contains four keyways 178*a*, 178*b*, 178*c* and 178*d*, these keyways having equal angular spacings, namely 90°. The other adapter sleeve 162 has projecting therefrom four keys 190*a*, 190*b* (a portion of the sleeve 162 having been broken away to show key 190*b*), 190*c* and 190*d*. Owing to the fact that the keys 190*a*, 190*b*, 190*c* and 190*d* are equal in number to the keyways 178*a*, 178*b*, 178*c* and 178*d*, plus the fact that they have the same angular spacing therebetween, it follows that when the sleeves 160 and 162 are snapped on the electrical connector 10, or one similar thereto, then the polarity is that which is determined by the four key configuration of the sleeve 160 and the four keyway configuration of the sleeve 162. In other words, a sleeve 160 will not permit mating of a component 12 with a connector component 14 having a sleeve 62 thereon, and a component 14 having a sleeve 162 thereon will not permit that component to be mated with a component 12 having a sleeve 60 thereon.

Figure 7:
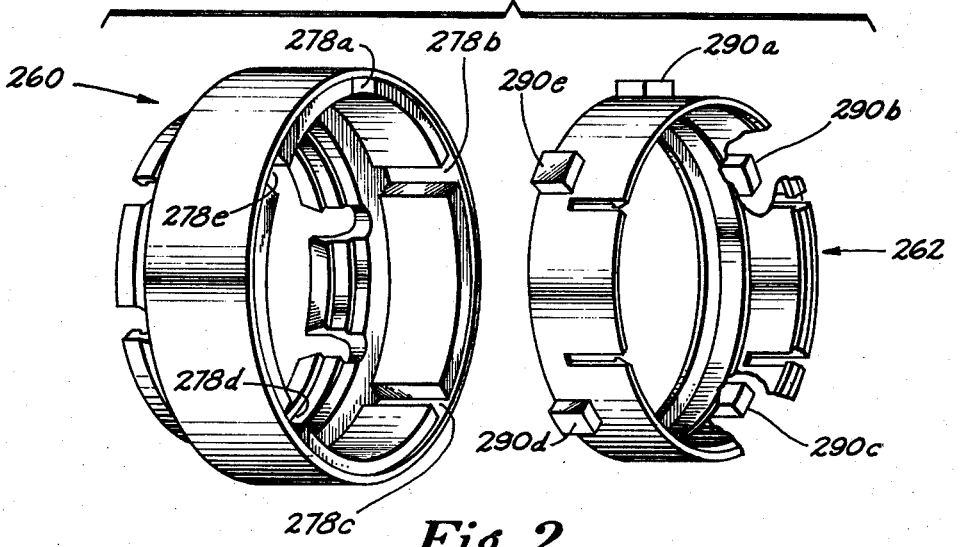
FIG. 7 is a perspective view corresponding to FIG. 6 but showing a third pair of adapter sleeves with still a different keying configuration.

To even more vividly portray the advantages to be derived from a practicing of our invention, FIG. 7 pictures two additional adapter sleeves 260 and 262. In this situation, the sleeve 260 has five keyways labeled 278*a*, 278*b*, 278*c*, 278*d* and 278*e*, whereas the sleeve 262 has projecting therefrom five keys 290*a*, 290*b*, 290*c* (portions of the sleeve 262 having been removed in order to show the keys 290*b*, 290*c* which would otherwise be concealed), 290*d* and 290*e*, the angular spacing, namely 72°, therebetween being the same as that for the keyways 278*a*, 278*b*, 278*c*, 278*d* and 278*e*.

Although only three polarity combinations have been illustrated, it will be appreciated that the number is virtually limitless. In other words, a myriad of polarity combinations can be provided via the plastic adapter sleeves by merely varying the number of keys and keyways. Still further, the various pairs of adapter sleeves 60 and 62, 160 and 162, 260 ad 262, may be of different colors, thereby facilitating the selection of components to be mated properly when their visibility is not observed.

We claim:

1. In combination with an electrical connector comprising a pair of mateable components, one of said connector components including a cylindrical shell of one diameter, and the other of said components including a shell of smaller diameter than said one diameter shell, and said other connector component further including a coupling ring of larger diameter than said one diameter shell so that said smaller diameter shell will fit within said one diameter shell and said coupling ring will fit over said one diameter shell, said one diameter shell having a circumferential groove extending therearound and said coupling ring also having a circumferential groove extending therearound, a first sleeve encircling an exterior portion of said one diameter shell having a predetermined keyway pattern, and a second sleeve encircling an exterior portion of said coupling ring having a predetermined key pattern complementing the keyway pattern of said first sleeve, said first sleeve including a cylindrical body freely and rotatably encircling said one diameter shell and having a plurality of resilient fingers extending therefrom with the free ends of said resilient fingers releasably engaging in the circumferential groove of said one diameter shell so that said first sleeve can be manually attached to, and manually removed from, said one diameter shell, and said second sleeve including a cylindrical body freely and rotatably encircling said coupling ring and having a plurality of resilient fingers extending therefrom with the free ends of said last-mentioned resilient fingers releasably engaging in the circumferential groove of said coupling ring so that said second sleeve can be manually attached to, and manually removed from, said coupling ring.

2. The combination of claim 1 in which said first sleeve includes an annular flange extending inwardly and said resilient fingers of said first sleeve projecting from the inner edge of said annular flange, and said sleeve having a diameter so that said second sleeve can be received within said first sleeve, the cylindrical body of said first sleeve having a plurality of angularly spaced, inwardly facing longitudinal keyways to provide said keyway pattern and said second sleeve having a plurality of angularly spaced, outwardly directed longitudinal keys providing said key pattern.

3. The combination of claim 2 including inwardly directed ribs on the free ends of said first spring fingers, said ribs extending into the circumferential groove of said one component, and including inwardly directed ribs on the free ends of said second fingers, said last-mentioned ribs extending into the circumferential groove of said other component.

4. For use with electrical connectors comprised of two mateable components of conventional construction, a first plastic sleeve adapted to releasably fit over a portion of one of said components and a second plastic sleeve adapted to releasably fit over a portion of the other of said components, said sleeves having telescopically receivable sections and one of said telescopically receivable sections having a number of angularly spaced, longitudinally directed keys thereon and the other of said telescopically receivable sections having a number of angularly spaced, longitudinally directed keyways therein, said keys and keyways corresponding in number and angular spacing so that said one conventional component can be mated with said other conventional component when said first sleeve is on said one component and said second sleeve is on said other component but in which said one component cannot be mated with an otherwise mateable third conventional component when said third component has a third sleeve detachably carried thereon provided with keyways differing in number or angular spacing from those of said second sleeve, and said other conventional component cannot be mated with an otherwise mateable fourth conventional component when said fourth component has a fourth sleeve thereon provided with keys differing in number or angular spacing from those of said first sleeve.

5. The sleeves of claim 4 in which the telescopically receivable section of said first sleeve fits within the telescopically receivable section of said second sleeve.

6. The sleeves of claim 5 in which said keys are on said first section and said keyways are on said second section.

7. The sleeves of claim 6 in which said sleeves each have a plurality of resilient plastic fingers for engaging said component portions.

8. The sleeves of claim 7 in which in fingers of said first sleeve reside in one cylindrical plane and the fingers of said second sleeve reside in a second cylindrical plane.

9. The sleeves of claim 8 in which the free ends of said fingers have inwardly directed ribs.

10. In combination with an electrical connector comprising a first component including a cylindrical shell having an open end and a plurality of electric contacts contained in said shell, a second component including a cylindrical shell having an open end and a plurality of electrical contacts contained in the shell of said second component which are mateable with the contacts of said first component when said open ends are telescoped together, said second component further including a coupling ring encircling the shell thereof for advancing said second shell with respect to said first shell to cause engagement of the contacts of said second component with those of said first component, said coupling ring having an open end for receiving therein the open end of the shell of said first component, and the shell of said first component having a circumferential groove spaced from its said open end and said coupling ring having a circumferential groove spaced from its said open end, the improvement comprising first and second telescopicable adapter sleeves formed with a plurality of interfitting longitudinal keys and longitudinal keyways providing a specific polarity pattern to prevent the mismating of components physically similar to either of said first and second components, said first adapter sleeve having a plurality of resilient fingers with end portions thereof releasably engageable in the circumferential groove of the shell of said first component, and said second adapter sleeve having a plurality of resilient fingers with end portions releasably engageable in the circumferential groove of said coupling ring.

11. The combination in accordance with claim 10 in which said first adapter sleeve has a slight counterbore adjacent the end thereof remote from its resilient fingers, said keyways extending longitudinally from said counterbore toward its said resilient fingers, and said second sleeve having an outer diameter adjacent the end thereof remote from its said resilient fingers corresponding to that of said counterbore so that said end of said second sleeve can rotate freely in said counterbore, said second sleeve having said keys thereon so that said free rotation ceases when said keys enter said keyways.

12. A kit containing a number of paired adapter sleeves for preventing the mismating of electrical connector components, the two adapter sleeves of each pair each comprising a cylindrical body with one of the cylindrical bodies of each pair having an internal diameter portion of a size sufficient to telescopically receive therein an external diameter portion of the other sleeve of that pair, each body having a plurality of resilient fingers for releasably engaging a connector component, the paired adapter sleeves having a corresponding or matching key and keyway pattern to prevent the interfitting and mismatching of unpaired adapter sleeves.

13. A kit in accordance with claim 12 in which at least two adapter sleeves that are paired have three longitudinally directed keys and keyways and in which at least two adapter sleeves that are contrastingly paired have a different number of longitudinally directed keys and keyways, said keys being on the external diameter portions and said keyways being on the internal diameter portions of said sleeves.

14. A kit in accordance with claim 12 in which said one cylindrical bodies are counterbored to receive therein said other sleeves.

15. A kit in accordance with claim 12 in which said paired adapter sleeves are plastic.

16. A kit in accordance with claim 15 in which said paired adapter sleeves are of different colors for the purpose of visually denoting those paired adapter sleeves having a corresponding or matching pattern from those paired adapter sleeves having a different corresponding or matching pattern.

* * * * *